US007143623B1

(12) United States Patent
Turnbull et al.

(10) Patent No.: US 7,143,623 B1
(45) Date of Patent: Dec. 5, 2006

(54) SHELL PRESS AND METHOD OF MANUFACTURING A SHELL

(75) Inventors: Robert Dean Turnbull, Massillon, OH (US); Donna Rebecca Stefansic, N. Canton, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 0 days.

(21) Appl. No.: 11/179,749

(22) Filed: Jul. 12, 2005

(51) Int. Cl.
*B21D 51/44* (2006.01)

(52) U.S. Cl. ..... 72/348; 72/379.4

(58) Field of Classification Search ..... 72/348, 72/347, 350, 379.2, 379.6
See application file for complete search history.

(56) References Cited

U.S. PATENT DOCUMENTS

| | | | | |
|---|---|---|---|---|
| 3,186,583 | A | 6/1965 | Zundel | |
| 3,525,455 | A | 8/1970 | Saunders | |
| 3,696,961 | A | 10/1972 | Holk, Jr. | |
| 3,705,563 | A | 12/1972 | Elser | |
| 3,765,352 | A | 10/1973 | Schubert et al. | |
| 3,848,557 | A | 11/1974 | Holk, Jr. | |
| 3,853,080 | A | 12/1974 | Zundel | |
| 3,868,919 | A | 3/1975 | Schracker et al. | |
| 3,871,314 | A | 3/1975 | Stargell | |
| 3,939,787 | A | 2/1976 | Morrison et al. | |
| 3,949,692 | A | 4/1976 | DeLine et al. | |
| 4,511,299 | A | 4/1985 | Zysset | |
| 4,516,420 | A | 5/1985 | Bulso, Jr. et al. | |
| 4,574,608 | A | 3/1986 | Bulso, Jr. et al. | |
| 4,587,825 | A | 5/1986 | Bulso, Jr. et al. | |
| 4,587,826 | A | 5/1986 | Bulso, Jr. et al. | |
| 4,713,958 | A | 12/1987 | Bulso, Jr. et al. | |
| 4,715,208 | A | 12/1987 | Bulso, Jr. et al. | |
| 4,716,755 | A | 1/1988 | Bulso, Jr. et al. | |
| 4,808,052 | A | 2/1989 | Bulso, Jr. et al. | |
| 5,020,955 | A | 6/1991 | Zumsteg | |
| 5,038,956 | A | 8/1991 | Saunders | |
| 5,970,775 | A | 10/1999 | McClung | |
| 6,014,883 | A | 1/2000 | McClung | |
| 6,425,721 | B1 | 7/2002 | Zysset | |
| 6,428,261 | B1 | 8/2002 | Zysset | |
| 6,685,417 | B1 | 2/2004 | Heinicke et al. | |
| 7,036,348 | B1 * | 5/2006 | McClung | 72/348 |
| 2003/0034346 | A1 | 2/2003 | Turner et al. | |
| 2003/0042258 | A1 | 3/2003 | Turner et al. | |
| 2004/0065663 | A1 | 4/2004 | Turner et al. | |
| 2004/0200838 | A1 | 10/2004 | Turner et al. | |
| 2004/0211780 | A1 | 10/2004 | Turner et al. | |
| 2005/0006388 | A1 | 1/2005 | Turner et al. | |
| 2005/0044920 | A1 | 3/2005 | McClung | |
| 2005/0044921 | A1 * | 3/2005 | McClung | 72/348 |
| 2006/0010953 | A1 * | 1/2006 | Turner et al. | 72/348 |

* cited by examiner

*Primary Examiner*—Lowell A. Larson
*Assistant Examiner*—Debra Wolfe
(74) *Attorney, Agent, or Firm*—David V. Maivald; Eckert Seamans Cherin & Mellott, LLC

(57) ABSTRACT

An apparatus and method for forming a shell with a central panel connected to a chuckwall with a z-fold located between the central panel and the chuckwall is provided. The apparatus and method of the invention is characterized by forming the z-fold in a downstroke of the press and supporting the z-fold in an upstroke of the press. The apparatus and method take place in a triple action die contained within a shell press. The apparatus and method can also be employed in a single action press or a double action press.

14 Claims, 9 Drawing Sheets

SHELL PRESS AND METHOD OF MANUFACTURING A SHELL

FIELD OF THE INVENTION

The present invention generally relates to an apparatus and method for forming container end panels, commonly called shells, from a sheet of blanked material. More particularly, the present invention relates to a single or double action press and method for forming a shell having a z-fold formed in a downstroke of the press with a triple action die, wherein the z-fold is supported on an upstroke of the press.

BACKGROUND OF THE INVENTION

The forming of can ends or shells for containers, namely aluminum or steel cans, is well-known in the art. Representative patents disclosing shell formation include Bulso U.S. Pat. Nos. 4,516,420 and 4,549,424. As is typically seen, a shell in its completed form includes a central panel, an outer rim than generally extends upward from the central panel called a chuckwall, and a thick, recessed groove that encircles the central panel between the central panel and the outer rim, commonly referred to as a countersink.

The countersink generally is used to enable attachment of a converted shell to a can base. Adversely, however, the countersink creates several disadvantages. The countersink provides a narrow groove in which excess liquid can be caught, which can be an annoyance to consumers. Further, the countersink can become an undesired receptacle for dirt or other unwanted substances, thereby potentially contaminating the contents of the can during use. On the financial front, the countersink uses excess metal material, thereby increasing cost.

Consequently, a need exists in the art for a can end or shell that does not include a countersink groove between the central panel and the outer rim, that is still attachable to the can body. One reference that attempts to accomplish this is United States Publication No. US 2004/0217780 to Turner et al. Turner attempts to achieve a shell that does not have a countersink through the creation of a z-fold between the central panel and the chuckwall. However, this application discloses a method that in practice forms a shell that is susceptible to failure. Turner uses a double action press with a double action die, and forms and sets the shell on a down stroke of the press without supporting the z-fold on the upstroke of the press. It was found, however that setting of the z-fold on the down stroke with a double action die creates a shell susceptible to failure, and the resultant shell's z-fold tended to unfold or was overly strain hardened. It is believed that the z-fold unfolds because the z-fold is not supported on the upstroke of the press. Also, it is believed that the z-fold is overly strain hardened because the z-fold is fully formed on the downstroke and not supported on the upstroke of the press. The overly strain hardened material of the z-fold can cause the material to fracture, rupture or cause leaks in the shell. Thus, a need remains for a countersink free shell with improved properties and manufacturability over the prior art.

SUMMARY OF THE INVENTION

Accordingly, an object of the present invention is to provide a method for forming a shell that eliminates the countersink between the central panel and the chuckwall through the creation of a z-fold.

Another object of the invention is to provide a method and apparatus for forming a shell with a central panel connected to a chuckwall with a z-fold located between the central panel and the chuckwall that is not susceptible to failure.

Another object of the invention is to provide a method and apparatus for forming a shell with a central panel connected to a chuckwall with a z-fold located between the central panel and the chuckwall that does not have the z-fold unfold after formation.

Another object of the invention is to provide a method and apparatus for forming a shell with a central panel connected to a chuckwall with a z-fold located between the central panel and the chuckwall that does not overly strain harden the z-fold during the fold formation process.

Certain objects of the invention are achieved by providing a method for forming a shell from material at a shell press assembly, in a press with one or a multiplicity of shell press assemblies. The method comprises the following steps: i) moving the material into the assembly between a set of upper toolings and a set of lower toolings; ii) blanking the material in a downstroke of the press to form a blank; iii) forming the blank into a shell with a central panel connected to a chuckwall; iv) forming a radius in the shell wherein the radius is located between the chuckwall and the central panel; v) forming a z-fold in the shell in a downstroke of the press wherein the z-fold is located between the chuckwall and the central panel; and vi) supporting the z-fold formed in the shell on an upstroke the press by moving the lower toolings and upper toolings upwards with the shell disposed between the toolings in a pressure relationship.

Other objects of the invention are achieved by providing a method for forming a shell from material at a shell press assembly, in a press with one or a multiplicity of shell press assemblies. The assembly has a punch holder and a die holder. The method comprises the following steps: i) moving material into the shell press assembly between a set of upper toolings and a set of lower toolings, wherein the upper toolings include a punch core, an inner pressure pad radially outward the punch core, an outer pressure pad radially outward the inner pressure pad, and a punch shell radially outward the outer pressure pad, and wherein the lower toolings comprise a die core, a die core ring radially outward the die core, a lower pressure pad radially outward the die core ring, and a blank cutedge radially outward the lower pressure pad; ii) moving the upper toolings downward wherein the material is blanked between the punch shell and the blank cutedge; iii) forming the blank into a shell with a central panel connected to a chuckwall from the material disposed between the punch core, the inner pressure pad, the outer pressure pad, the die core and the die core ring; iv) forming a z-fold in the shell in a downstroke of the press with the z-fold located between the chuckwall and the central panel wherein the z-fold is formed from the material located between the inner pressure pad, the die core and the die core ring, and v) supporting the z-fold formed in the shell on an upstroke the press by supporting the z-fold located between the inner pressure pad, the die core and the die core ring.

Other objects of the invention are achieved by providing an apparatus for forming a shell having a central panel and a chuckwall with a z-fold located between the central panel and the chuckwall in a triple action die. The apparatus has a punch core, an inner pressure pad concentrically disposed around the punch core and located radially outward from the punch core, an outer pressure pad concentrically disposed around the inner pressure pad and located radially outward from the inner pressure pad and a punch shell concentrically disposed around the outer pressure pad and located radially outward from the outer pressure pad. The apparatus also has a die core located in opposed relationship to the punch core and the inner pressure pad, a die core ring concentrically disposed around the die core and located radially outward from the die core in opposed relationship to the inner pressure pad and the outer pressure pad, a lower pressure pad concentrically disposed around the die core ring and located radially outward from the die core ring in opposed relationship to the punch shell and a blank cutedge located radially outward from the lower pressure pad. The punch shell is structured to blank a sheet of material against the blank cutedge during descent of the punch shell. The punch core, the inner pressure pad and the outer pressure pad are structured to form the blank into a shell with a central panel connected to a chuckwall from the blank disposed between the punch core, the inner pressure pad, the outer pressure pad, the die core and the die core ring. The inner pressure pad is structured to form a z-fold in the shell in a downstroke of the press with the z-fold located between the chuckwall and the central panel wherein the z-fold is formed from the material located between the inner pressure pad, the die core and the die core ring. The z-fold formed in the shell is supported on an upstroke of the press by supporting the z-fold between the inner pressure pad, the die core and the die core ring.

DESCRIPTION OF THE PREFERRED EMBODIMENTS

Figure 1:
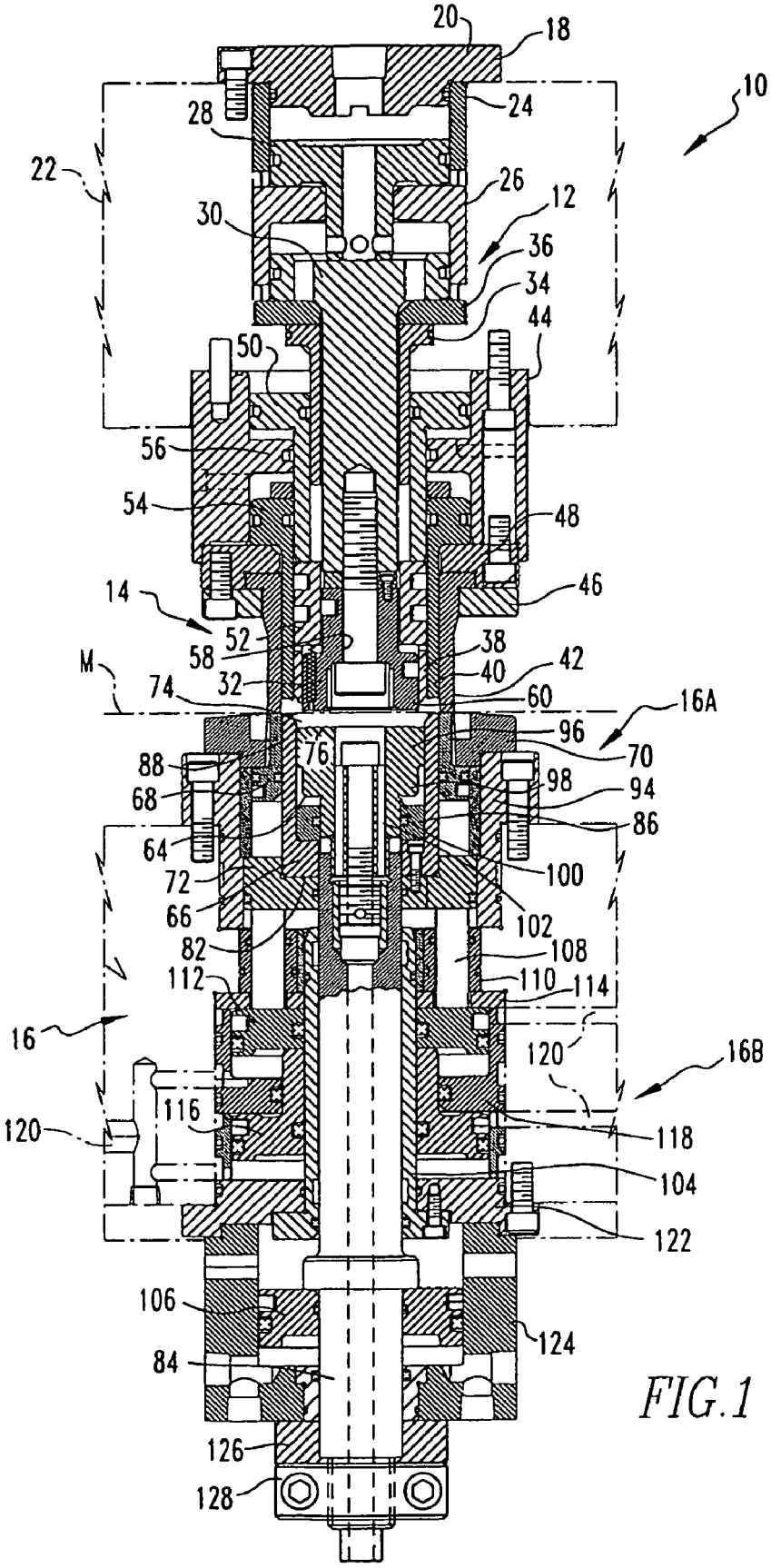
FIG. 1 is cross-sectional view of a single action shell press assembly.

For purposes of the description hereinafter, the terms "upper", "lower", "vertical", "horizontal", "axial", "top", "bottom", "aft", "behind" and derivatives thereof shall relate to the invention, as it is oriented in the drawing figures. However, it is to be understood that the invention may assume various alternative configurations except where expressly specified to the contrary. It is also to be understood that the specific elements illustrated in the drawings and described in the following specification are simply exemplary embodiments of the invention. Therefore, specific dimensions, orientations and other physical characteristics related to the embodiments disclosed herein are not to be considered limiting.

As employed herein, the term "number" refers to one or more than one (i.e., a plurality). As employed herein, the term "fastener" refers to any suitable fastening, connecting or tightening mechanism expressly including, but not limited to, integral rivets. As employed herein, the statement that two or more parts are "coupled" together shall mean that the parts are joined together either directly or joined through one ore more intermediate parts.

Turning to FIG. 1, one embodiment of the invention, a single action shell press assembly 10, is shown. Material M is fed into the shell press assembly 10 to form a shell from the material M. It should be understood that shell press assembly 10 may be one of multiple shell press assemblies mounted within a single machine. 12, 24 or any number of shell press assemblies may be mounted within a large housing that makes up the structure of the shell press machine, wherein rams of the machine are movable up and down in an axial direction relative to the stationary housing of the shell press machine.

Shell press assembly 10 generally includes three sections, an inner punch holder 12, an outer punch holder 14, and a die holder 16. Material M is generally formed between inner punch holder 12, outer punch holder 14 and die holder 16, which carry the tooling for the formation of a shell.

Inner punch holder 12 includes a punch cap 18 on which a punch center 20 is mounted. The punch cap 18 is mounted within ram 22, generally depicted by dashed lines. Punch cap 18 is, in turn, coupled to a punch cap cylinder 24. Cylinder 26 is located below cylinder 24 and may be separated from cylinder 24 by a spacer.

Cylinder 24 and cylinder 26 define a cavity for receiving a piston 28 and a punch core riser 30. Punch core riser 30 is located beneath piston 28. As will be understood, piston 28 is movable in an axial direction to urge punch core riser 30 in a downward motion and, by extension, can urge a punch core 32 toward die holder 16.

Punch core riser 30 is partially encased by a sleeve 34. A recess is defined between sleeve 34 and punch core riser 30 and cylinder 26 for receiving spacer 36, wherein spacer 36 distances the sleeve 34 from cylinder 26. As sleeve 34 raises and lowers with punch core riser 30, spacer 36 maintains a barrier between axially mobile sleeve 34 and cylinder 26.

Outer punch holder 14 can be axially raised and lowered toward and away from die holder 16. The punch core 32 is coupled to the inner punch holder 12 by punch core riser 30 which is coupled to ram 22. Outer punch holder 14 includes punch core 32, inner pressure pad 38 disposed concentrically around the punch core 32, outer pressure pad 40 disposed concentrically around the inner pressure pad 38 and punch shell 42 disposed concentrically around the outer pressure pad 40. Inner pressure pad 38, outer pressure pad 40 and punch shell 42 are coupled to ram 22 and partially held within retainer 44, wherein retainer 44 defines a cavity for receiving a series of pistons and components that move axially away from and toward die holder 16. Punch shell 42 is coupled to the interior of retainer 44 by punch shell clamp 46 and punch shell retainer 48. The punch shell 42 includes a lower surface that is contoured. For example, the lower surface of punch shell 42 is generally flat with a rounded corner along a radially inward corner of the lower surface.

Upper piston 50 is concentrically disposed around punch core riser 30 in operable relation, such that the upper piston 50 can move in an axial direction relative to punch core riser 30. Upper piston 50 is in operable relation to upper pressure sleeve 52, such that downward movement of upper piston 50 results in corresponding downward movement of upper pressure sleeve 52. Disposed beneath upper pressure sleeve 52 is the inner pressure pad 38 concentrically disposed around the punch core 32. Downward movement of the upper pressure sleeve 52 results in corresponding downward movement of the inner pressure pad 38. A lower tip of inner pressure pad 38 is contoured to provide a desired curvature to material M. For example, inner pressure pad 38 may have a flat region on a radially inward side, and a general arc upward toward the radially outward side.

Upper pressure pad 54 is concentrically disposed around the upper piston 50, upper pressure sleeve 52 and inner pressure pad 38 which is axially movable within retainer 44 in operable relation, such that the upper pressure pad 54 can move upwards and downwards relative to the retainer 44. Upper pressure pad 54 includes outer pressure pad 40, a downwardly extending flange. A lower tip of outer pressure pad 40 is contoured to provide a desired curvature to material M. For example, outer pressure pad 40 may have a generally asymmetrical concave surface, wherein its radially inward lower tip extends slightly lower than its radially outward lower tip.

As can be seen in FIG. 1, retainer 44 may have portion 56 that extends radially inward, toward the upper piston 50 and above upper pressure pad 54. Punch core 32 generally includes a cylindrical bore 58 that extends axially through the cavity for coupling the punch core 32 to the punch core riser 30. Punch core 32 further includes a radially extending shoulder portion 60 that extends radially outward from the punch core 32. A lower portion of shoulder portion 60 is contoured to provide a desired curvature to material M. For example, the punch core 32 may include an annular nose 62 on a radially outward lower surface.

Die holder 16 is located opposite inner punch holder 12 and outer punch holder 14 along the same axis. Inner punch holder 12, outer punch holder 14 and die holder 16 interact to form material M, as described more completely below. In the example shown, the die holder 16 has upper and lower sections, respectively 16A and 16B. The upper section 16A generally includes die core 64, die core ring 66, lower pressure pad 68, blank cutedge 70 and die core ring retainer 72.

At the radial center of die holder 16A, within cavity 74, is die core 64 which is opposed to the punch core 32. Die core 64 has an upper surface 76 that interacts with the punch core 32 during shell formation. Die core ring 66 is held within cavity 74 of upper section 16A, concentrically disposed around die core 64 in opposed relationship to the outer pressure pad 40 and is located radially outward of die core 64, and has a beveled top 78 that leads downwardly toward the die core 64. Beveled top 78 leads downward to recessed portion 80 of the die core 64. The shape of the die core ring 66, along with the recessed portion 80 of the die core 64, allows it to cooperate with the opposing tools of the outer punch holder 14. The die core ring 66 further comprises a radially inward extending portion 82 along a lower surface of the die core ring 66. Portion 82 extends inwardly toward die core shaft 84. Bottoming pads 86 are located on top of the radially inwardly extending portion 82 of the die core ring 66, a spaced distance beneath the die core 64.

Lower pressure pad 68 concentrically disposed around the die core ring 66 in opposed relationship to the punch shell 42 is located radially interior of blank cut edge 70 and radially exterior of the die core ring 66. Lower pressure pad 68 has a generally cylindrical configuration having a base portion and an upstanding wall portion. The base portion has a thickness greater than the wall portion with the wall portion extending axially upward from the base portion at its radial outer extremity such that the wall portion and base portion share a common interior surface. The wall portion generally extends to that of the operative end of die holder 16. At the lower pressure pad's vertical upper extremity 88, the lower pressure pad 68 may be provided with a flat surface 90 into which the peripheral edge of the material is pressed by the punch shell 42. Surface 90 may further comprise generally rounded corners 92. Blank cutedge 70 is concentrically disposed around the lower pressure pad 68 is generally coupled to the top of blank cutedge retainer 94.

Die core 64 is located at the center of die holder 16, radially interior to die core ring 66 and lower pressure pad 68. Die core 64 includes a shoulder portion 96 that substantially fills the area between the die core 64 and die core ring 66. A collar portion extends axially downward from the shoulder portion 96 at a point radially inward from the shoulder portion defining a lower shoulder 98. The lower shoulder 98 extends inwardly into a small rounded recess 100, and then extends downward and inwardly again into a lower ring 102. Shoulder portion 96, lower shoulder 98 and lower ring 102 each share a common interior surface that defines a bore to couple the die core 64 to the die core shaft 84 Note that in other embodiments, the exact shape and movement of the non wear tooling components that are not directly touching the material M during formation of the shell can vary significantly while maintaining the spirit of the invention.

The central axis of die holder 16 generally comprises die core shaft 84. The die core shaft 84 extends from the lowermost area of die holder 16 toward die core 64, partially covered by sleeve 104. The die core shaft 84 acts as a support for the die core 64, and, when activated by piston 106, can move upward and downward in an axial direction, thereby urging the die core 64 towards and away from the outer punch holder 14.

Pressure rod 108, which is preferably surrounded by bushing 110, generally separates the upper 16A and lower portion 16B of die holder 16. In lower portion 16B, a series of pistons can urge the pressure rod 108 in an axial motion upward towards the outer punch holder 14, which in turn can axially move the die core ring 66 upward. Reform piston 112 is beneath pressure rod 108. The reform piston 112 is further coupled to sleeve 104, which surrounds a portion of the die core shaft 84. Above the reform piston 112 is hardened spacer 114.

Lower piston 116 is preferably a generally L-shaped piston having a lower thicker portion and a flange that extends upward from the interior side of the thicker portion. The lower thicker portion and the flange each share an interior side that is coupled to sleeve 104. A top portion of the lower piston 116 comes into operable contact with the reform piston 112, thereby having the ability to urge the die core ring 66 in an axial direction. The reform piston 112 and the lower piston 116 form a cavity for receiving cylinder 118. Cylinder 118 is preferably placed radially outward from the flange of the lower piston 116.

The pressure rod 108 acts as a thermal for compensating for thermal growth that occurs during operation of the shell press machine. Lower portion 16B is also equipped with air passages, represented by the number 120. The air passages 120 may selectively provide air to lower piston 116 and reform piston 112 to urge the pistons upward into pressure rod 108 which urges the die core ring 66 upward.

At the bottom of lower portion 16B, beneath lower piston 116, is cap 122, which is coupled to a lower extremity of sleeve 104. Beneath cap 122 is a cylinder 124, which defines a cavity in which piston 106 for the die core shaft 84 is placed. Piston 106 is coupled to die core shaft 84 and can urge the die core shaft 84 upward and downward in an axial direction. Coupled to cylinder 124 is bumper 126 and split nut 128, which in turn fasten to the housing of the machine.

Figure 2:
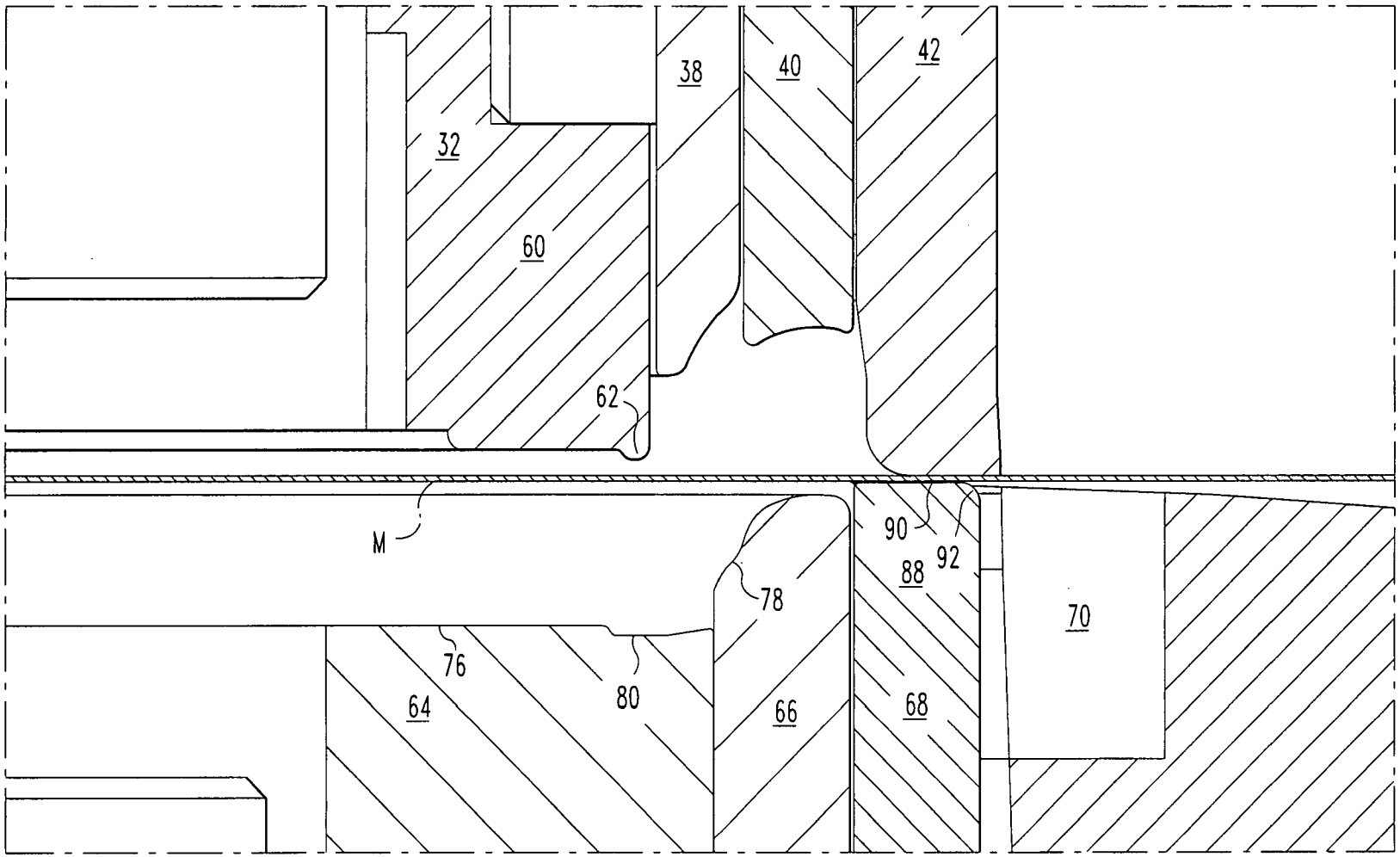
FIG. 2 is a partial cross-sectional view of a shell press formation assembly prior to blanking material.

Referring to FIGS. 2–8, the operation of the apparatus and method of the present invention will be described. In FIG. 2, material M has been inserted into the shell press assembly 10, either in sheet form or from a coil of material M, and is interposed between the inner punch holder 12, the outer punch holder 14 and the upper die holder 16A. The outer punch holder 14 contains at least four tools from radially inward to radially outward: punch core 32 with shoulder 60 and annular nose 62, inner pressure pad 38 concentrically disposed around the punch core 32, outer pressure pad 40 concentrically disposed around the inner pressure pad 38 and punch shell 42 concentrically disposed around the outer pressure pad 40. These tools can be manipulated in an upward and downward motion by the ram 22 as discussed above. Punch core 32 may also be axially extended by activation of piston 28. Inner pressure pad 38 may be axially extended by activation of piston 50. Outer pressure pad 40 may be axially extended by supplying air above upper pressure pad 54. The upper die holder 16A contains at least four tools, from radially inward to outward: die core 64 with surface 76 and recessed portion 80, die core ring 66 concentrically disposed around the die core 64 with beveled top 78, lower pressure pad 68 concentrically disposed around the die core ring 66 with surface 90, and blank cutedge 70 concentrically disposed around the lower pressure pad 68. The die core 64 may be axially moved upward and downward by supplying air to one side or the other side of piston 106. Die core ring 66 may be axially moved upward by the pressure rod 108. Lower pressure pad 68 may be axially moved upward by supplying air beneath the lower pressure pad 68. Note that FIGS. 2–8 depict one radial cross-section of the wear tooling of the shell press assembly 10, and that each of the tools depicted extend from the page in a generally circular manner in front of, behind and to the side of the page.

In FIG. 2, the ram 22 begins its descent towards the die core 16 and the punch shell 42 blanks the material M against the blank cutedge 70. The descent of the punch core riser 30 coupled to the ram 22 is the first action of the triple action die of the present invention.

Figure 3:
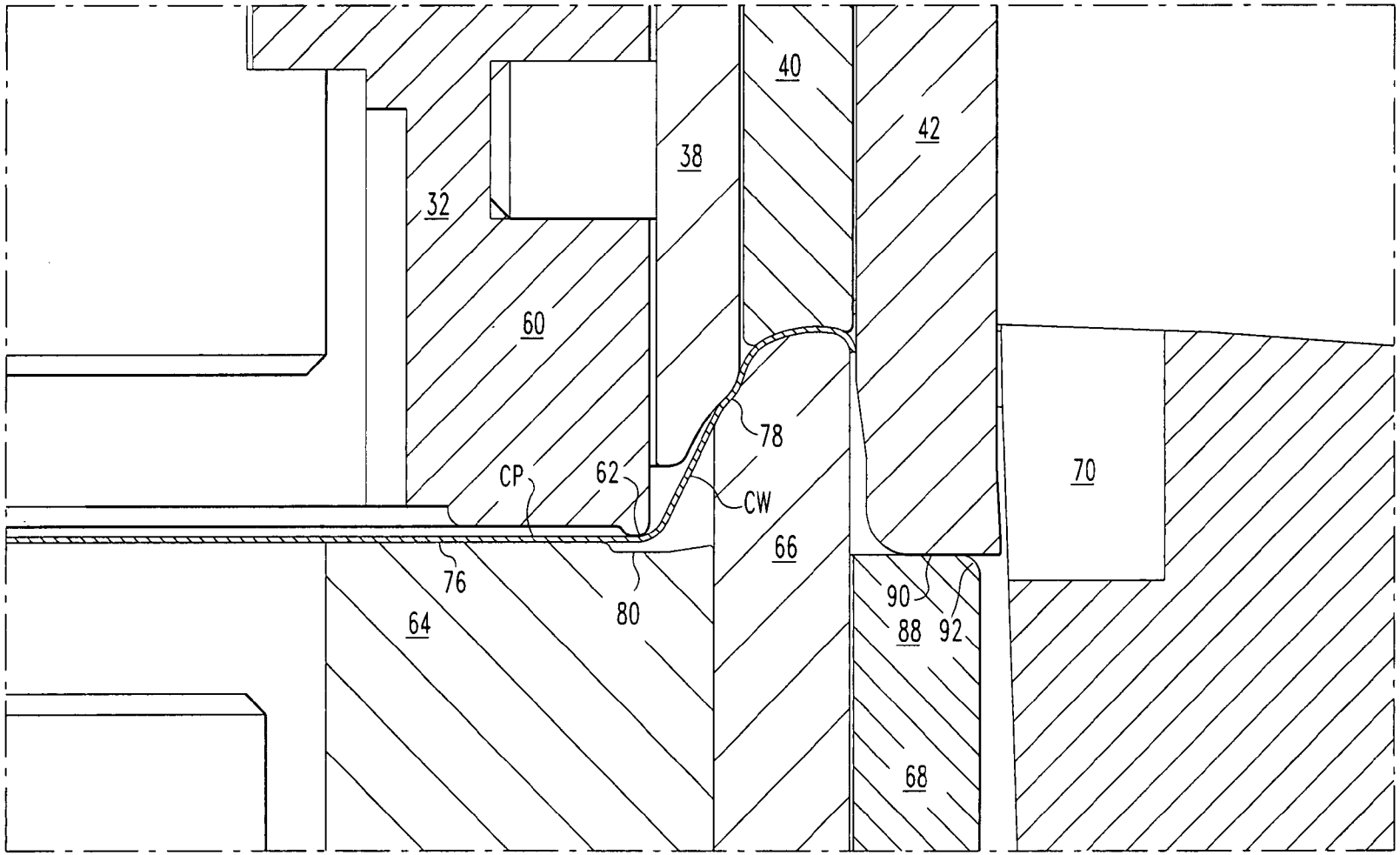
FIG. 3 is a partial cross-sectional view of a shell press formation assembly after partial formation of a central panel and a chuckwall of a shell.

In FIG. 3, continued descent of the ram 22 preliminary forms the material M into a shell having a central panel CP joined to a chuckwall CW from material M located between the punch core 32, inner pressure pad 38, outer pressure pad 40, die core 64 and die core ring 66. In FIG. 3, the punch core 32 has just come in contact with the die core 64 along annular nose 62. The punch core 32 begins to urge the die core 64 downward along with the die core shaft 84 overcoming the pressure beneath the piston 106. The descent of the die core shaft 84 downward is the second action of the triple action die of the present invention. In the step shown in FIG. 3, die core ring 66 begins to urge the upper pressure pad 54 upward overcoming the pressure above the upper pressure pad 54. As can be seen, punch core 32 has advanced toward die core 64, inner pressure pad 38 has advanced toward the die core 64 and the die core ring 66 with its beveled top 78, and punch shell 42 has advanced toward lower pressure pad 68, pushing it downward overcoming the pressure beneath the lower pressure pad 68. The punch shell 42 wipes the peripheral edge of the shell about the periphery of the top of die core ring 66, so as to form a cup or hat. The outer pressure pad 40 in cooperation with the die core ring 66 serve the function of holding the material M secure as for the remainder of the shell forming process.

Figure 4:
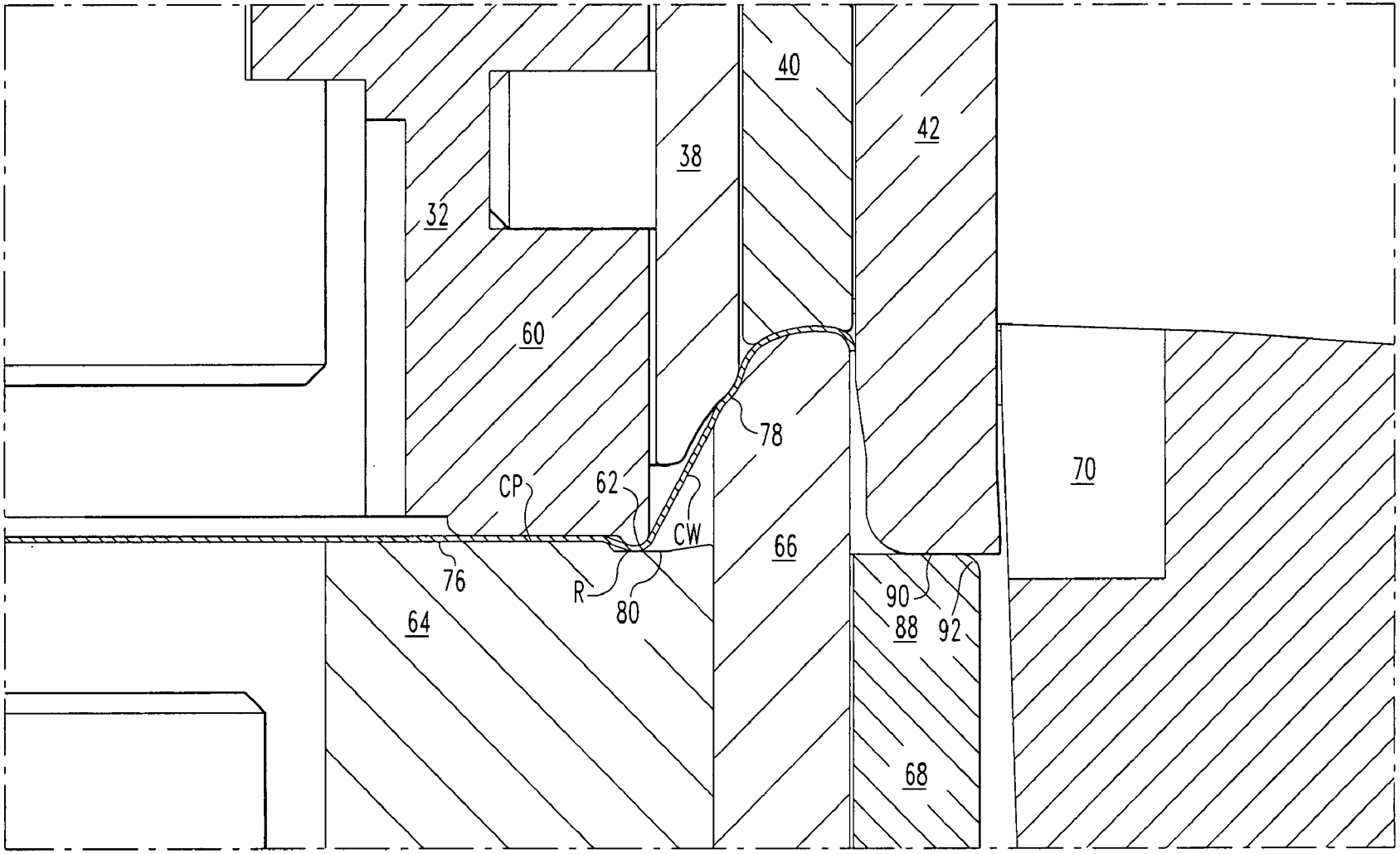
FIG. 4 is a partial cross-sectional view of a shell press formation assembly after formation of a radius located between a central panel and a chuck wall of a shell.

In FIG. 4, the annular nose 62 of punch core 32 engages the material M, thereby substantially forming countersink radius R between the central panel CP and chuckwall CW. The material M is held between inner pressure pad 38, outer pressure pad 40 and the die core ring 66 during this step. In this step, the ram 22 continues its downward descent and the punch core 32 continues to urge the die core 64 and die core shaft 84 downward. Also, the upper pressure pad 54 urges the die core ring 66 downward which urges the pressure rod 108 downward along with the reform piston 112 and the lower piston 116. Additionally, the die core ring 66 urges the upper pressure pad 54 upward in this step overcoming the pressure above the upper pressure pad 54. Likewise, continued descent of the punch shell 42 continues to push the lower pressure pad 68 downward overcoming the pressure beneath the lower pressure pad 68. In this step, the punch core 32, the inner pressure pad 38 and the punch shell 42 each further advance downward toward the die holder 16.

Figure 5:
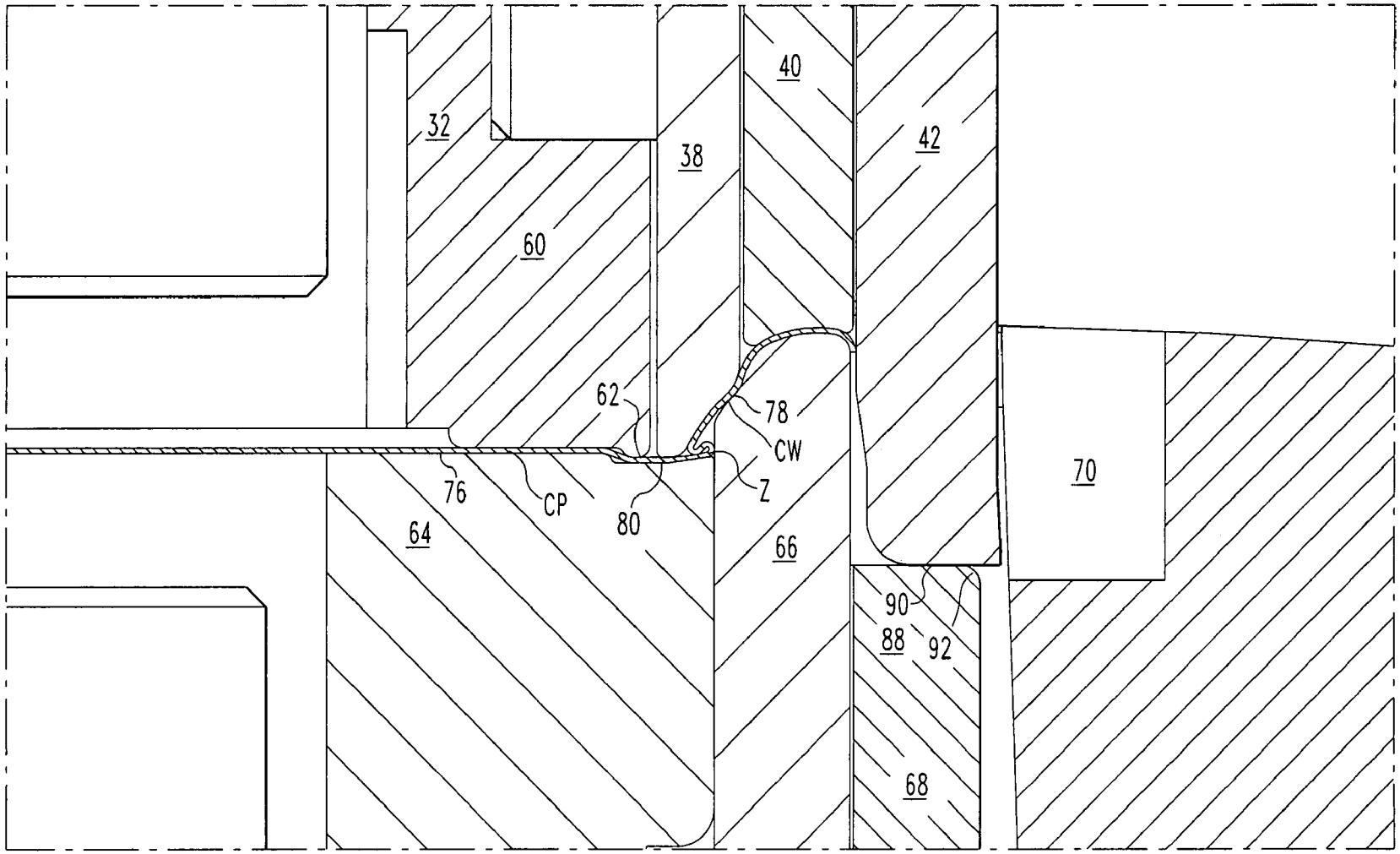
FIG. 5 is a partial cross-sectional view of a shell press formation assembly after formation of a z-fold located between a central panel and a chuck wall of a shell during a downstroke of the press.

In FIG. 5, a z-fold Z is formed between the central panel CP and the chuckwall CW of the shell on the downstroke of the press. Here, inner pressure pad 38 and outer pressure pad 40 have pushed down on die core ring 66 to bottom dead center, forming z-fold Z and the shell which pushes the die core ring 66 downward which urges the pressure rod 108 downward along with the reform piston 112 and the lower piston 116. Additionally, punch shell 42 has further advanced downward, engaging lower pressure pad 68 and overcoming the pressure beneath the lower pressure pad 68. The die core 64, die core ring 66, lower pressure pad 68, inner and outer pressure pads 38, 40 and the punch shell 42 have each reached their maximum distance downward. Thus, the press 10 as a whole has reached bottom dead center. In this step, the die core 64 pushes the punch core riser 30 upward overcoming the pressure above the piston 28.

The distance covered on the downstroke of the inner and outer pressure pad 38, 40 is controlled. If it extends too far, the z-fold Z will be overly strain hardened and distorted. If the downstroke extends too little, the z-fold Z is likely to unfold. The additional distance the inner and outer pressure pads 38, 40 travel between FIGS. 4 and 5 is around 0.143 inches which should not be considered to be a material limitation of the present invention.

Figure 6:
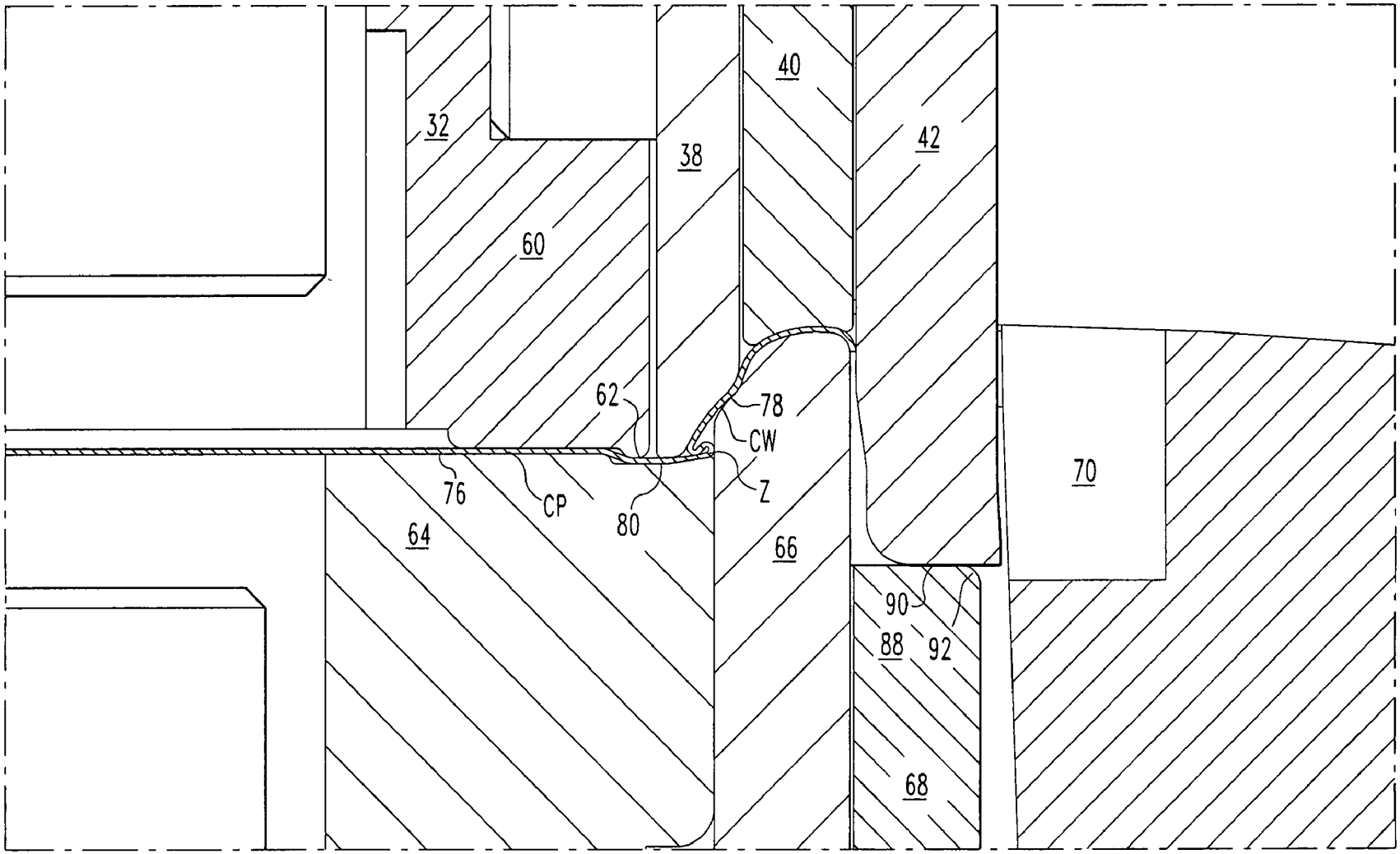
FIG. 6 is a partial cross-sectional view of a shell press formation assembly supporting a z-fold located between a central panel and a chuckwall of a shell during an upstroke of the press.
Figure 7:
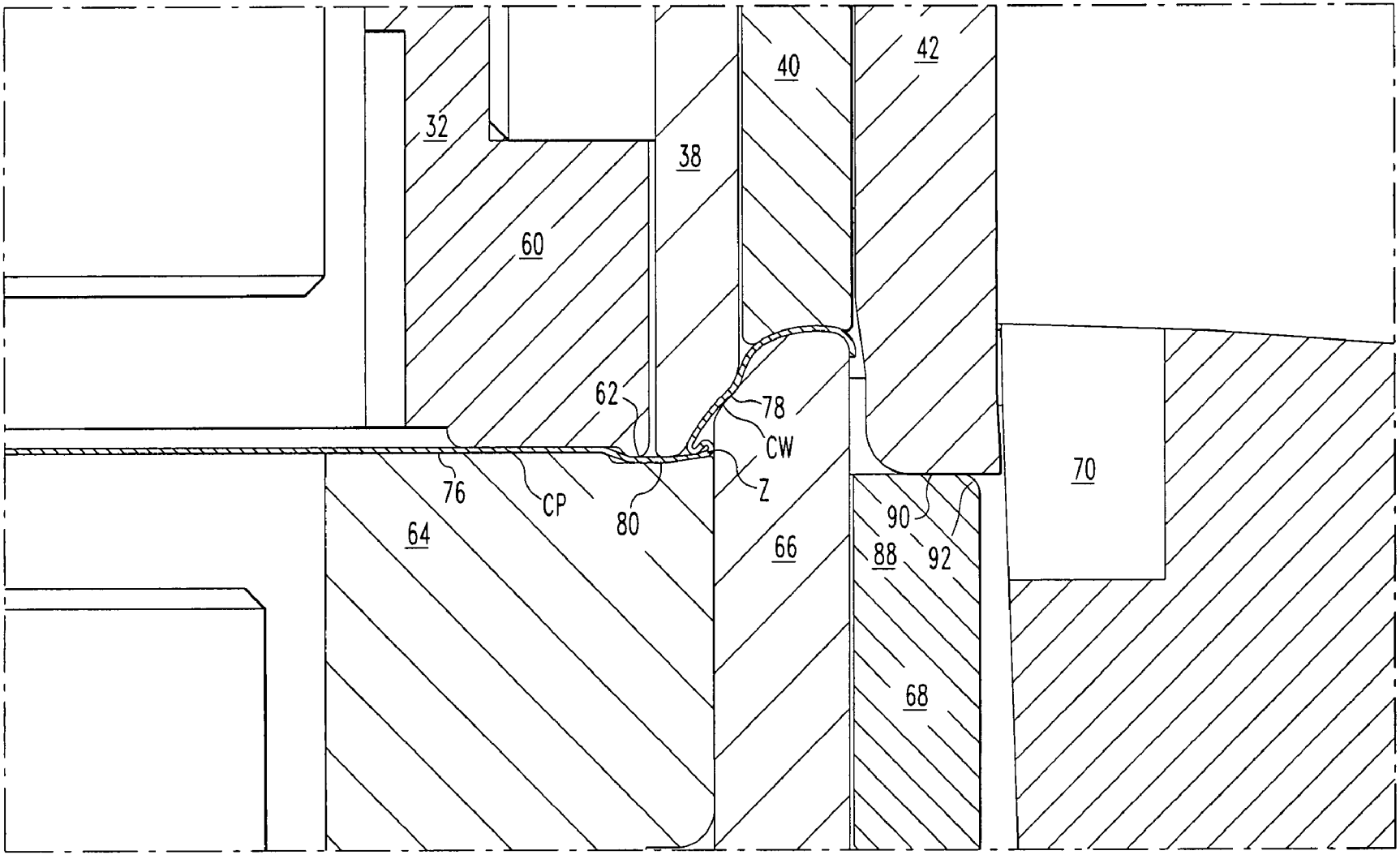
FIG. 7 is a partial cross-sectional view of a shell press formation assembly supporting a z-fold located between a central panel and a chuckwall of a shell during an upstroke of the press.

In FIGS. 6–7, z-fold Z is supported during the upstroke of the press. Ram 22 beings to pull away, and the die core 64 is pushed upward by the die core shaft 84 in response to pressure supplied beneath the piston 106. The ram 22 correspondingly pulls the toolings on the inner punch holder 12 and the outer punch holder 14 upward as well. Also, die core ring 66 is pushed upward in FIG. 6 by pressure supplied beneath lower piston 116 and reform piston 112 which urges pressure rod 108 upward. Additionally, lower pressure pad 68 is urged upward by air supplied beneath the component. During this upward movement, from FIGS. 6–7, the punch core 32, inner pressure pad 38, die core 64 and die core ring 66 cooperate with each other to support the z-fold Z formed in the shell during the upstroke of the press and the upward movement of the punch core riser 30 and die core shaft 84. This upward movement of the ram 22, the punch core riser 30 and the die core shaft 84 is the third action of the triple action die of the present invention.

Figure 8:
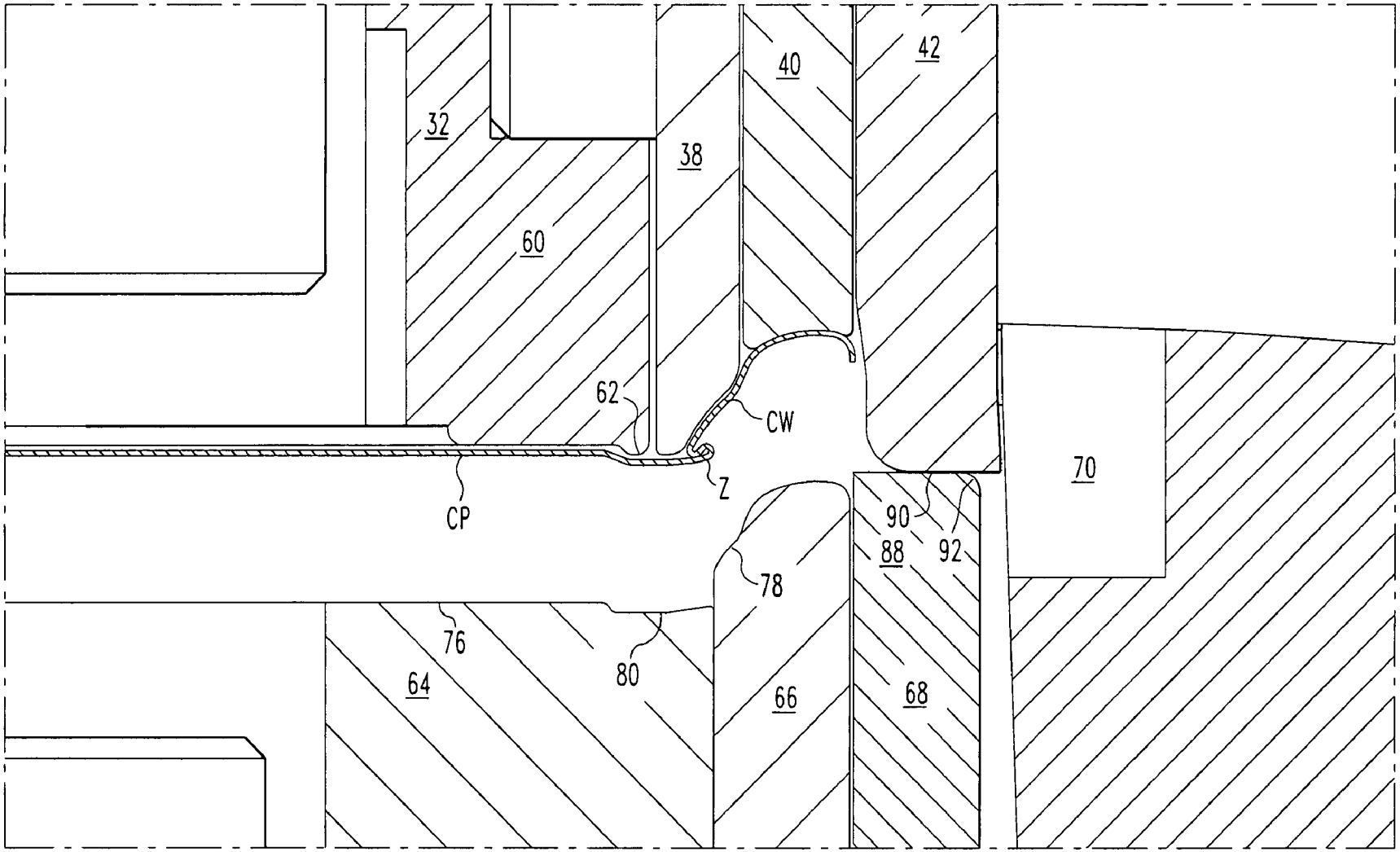
FIG. 8 is a partial cross-sectional view of a shell press formation assembly after formation of a shell.

As shown in FIG. 8, the ram 22 has moved up to its fullest extent and the shell with a z-fold Z between the central panel CP and the chuckwall CW has been formed in a controlled manner by the process of the present invention. The z-fold Z is formed during the downstroke of the press and is supported during the upstroke of the press. Now, the process of forming this shell with the shell press assembly 10 of the present invention may be repeated.

Figure 9:
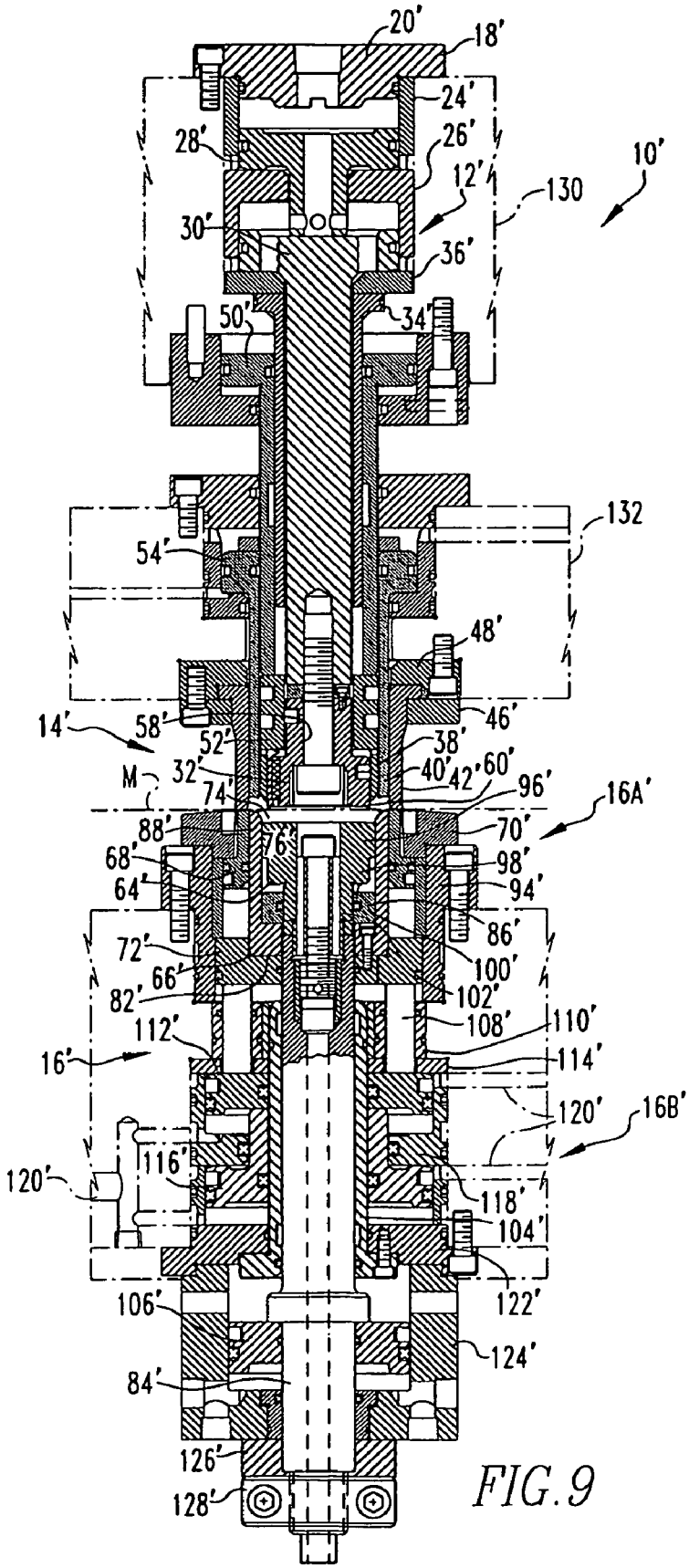
FIG. 9 is cross-sectional view of a double action shell press assembly.

In alternate embodiments, a double action press is used to form a shell with a z-fold. As shown in FIG. 9, the double action press comprises an upper and lower punch holder and a die holder, wherein the press has an upper ram 130 and a lower ram 132. In this embodiment, the punch core and the inner pressure pad wear tools are coupled to the upper ram 130 and the outer pressure pad and the punch shell are coupled to the lower ram 132. The wear tools of the double action press shown in FIG. 9 generally forms the shell in a substantially similar process as outlined in FIGS. 2–8. For the purpose of simplifying the patent specification, that process will not be repeated herein it being noted that the wear tools of FIG. 9 form the metal of the shell with a substantially similar process to that depicted in FIGS. 2–8 described above whereas the non-wear tools of the double action press of FIG. 9 are different in operation in some respects with comparison to the non-wear tools of the single action press of FIG. 1. Similar components presented in FIG. 9 that are also found in FIG. 1 are identified with a prime (') following the element number in FIG. 9. Double action presses have advantages and disadvantages over single action presses. For example, the single action press tends to be easier and less costly to manufacture, and thereby is a better value for a consumer. However, double action presses create less heat during use, reducing the risk of de-calibration during use. Additionally, an advantage of this invention over the prior art is that the process of the present invention can be used in a single action press or a double action press whereas prior art processes have focused on the use of a double action press. As such, the prior art does not give a canmaker that only has a single action press the capability of manufacturing a shell with a z-fold as described herein.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended hereto and any and all equivalents thereof.

What is claimed is:

1. A method for forming a shell from material in a shell press assembly, in a press with one or a multiplicity of shell press assemblies, comprising the steps of:

i) moving the material into the assembly between a set of upper toolings and a set of lower toolings, ii) blanking the material in a downstroke of the press to form a blank, iii) forming the blank into a shell with a central panel connected to a chuckwall, iv) forming a radius in the shell wherein the radius is located between the chuckwall and the central panel, v) forming a z-fold in the shell in a downstroke of the press wherein the z-fold is located between the chuckwall and the central panel, and vi) supporting the z-fold formed in the shell on an upstroke of the press by supporting the z-fold located between an inner pressure pad, a die core and a die core ring in a pressure relationship.

2. The method of claim 1, wherein the press is a single action press.

3. The method of claim 1, wherein the press is a double action press.

4. The method according to claim 1, wherein the upper toolings include a punch core, an inner pressure pad radially outward the punch core, an outer pressure pad radially outward the inner pressure pad, and a punch shell radial outward the outer pressure pad.

5. The method according to claim 1, wherein the lower toolings comprise a die core, a die core ring radially outward the die core, a lower pressure pad radially outward the die core ring and a blank cutedge radially outward the lower pressure pad.

6. The method according to claim 1, wherein the shell is formed in a triple action die contained within the press wherein a first action of the die comprises downward movement of a ram and a punch core riser, a second action of the die comprises downward movement of a die core shaft and a third action of the die comprises upward movement of the ram, the punch core riser and the die core shaft.

7. A method for forming a shell from material in a shell press assembly, in a press with one or a multiplicity of shell press assemblies, the assembly having a punch holder and a die holder, comprising the steps of:

(i) moving material into the shell press assembly between a set of upper toolings and a set of lower toolings, wherein the upper toolings include a punch core, an inner pressure pad radially outward the punch core, an outer pressure pad radially outward the inner pressure pad, and a punch shell radial outward the outer pressure pad, and wherein the lower toolings comprise a die core, a die core ring radially outward the die core, a lower pressure pad radially outward the die core ring, and a blank cutedge radially outward the lower pressure pad, (ii) moving the upper toolings downward wherein the material is blanked between the punch shell and the blank cutedge, (iii) forming the blank into a shell with a central panel connected to a chuckwall from the material disposed between the punch core, the inner pressure pad, the outer pressure pad, the die core and the die core ring, (iv) forming a z-fold in the shell in a downstroke of the press with the z-fold located between the chuckwall and the central panel wherein the z-fold is formed from the material located between the inner pressure pad, the die core and the die core ring, and (v) supporting the z-fold formed in the shell on an upstroke the press by supporting the z-fold located between the inner pressure pad, the die core and the die core ring.

8. The method of claim 7, wherein the press is a single action press.

9. The method of claim 7, wherein the press is a double action press.

10. The method according to claim 7, wherein the shell is formed in a triple action die contained within the press wherein a first action of the die comprises downward movement of a ram and a punch core riser, a second action of the die comprises downward movement of a die core shaft and a third action of the die comprises upward movement of the ram, the punch core riser and the die core shaft.

11. An apparatus for forming a shell having a central panel and a chuckwall with a z-fold located between the central panel and the chuckwall in a triple action die, the apparatus comprising:

a punch core, an inner pressure pad concentrically disposed around the punch core and located radially outward from the punch core, an outer pressure pad concentrically disposed around the inner pressure pad and located radially outward from the inner pressure pad, a punch shell concentrically disposed around the outer pressure pad and located radially outward from the outer pressure pad, a die core located in opposed relationship to the punch core and the inner pressure pad, a die core ring concentrically disposed around the die core and located radially outward from the die core in opposed relationship to the inner pressure pad and the outer pressure pad, a lower pressure pad concentrically disposed around the die core ring and located radially outward from the die core ring in opposed relationship to the punch shell, a blank cutedge located radially outward from the lower pressure pad, wherein the punch shell is structured to blank a sheet of material against the blank cutedge during descent of the punch shell, wherein the punch core, the inner pressure pad and the outer pressure pad are structured to form the blank into a shell with a central panel connected to a chuckwall from the blank disposed between the punch core, the inner pressure pad, the outer pressure pad, the die core and the die core ring, wherein the inner pressure pad is structured to form a z-fold in the shell in a downstroke of the press with the z-fold located between the chuckwall and the central panel wherein the z-fold is formed from the material located between the inner pressure pad, the die core and the die core ring, and wherein the z-fold formed in the shell is supported on an upstroke the press by supporting the z-fold between the inner pressure pad, the die core and the die core ring.

12. The apparatus of claim 11, wherein the press is a single action press.

13. The apparatus of claim 11, wherein the press is a double action press.

14. The apparatus of claim 11, wherein the triple action die has a first action comprising downward movement of a ram and a punch core riser, a second action comprising downward movement of a die core shaft and a third action comprising upward movement of the ram, the punch core riser and the die core shaft.

* * * * *